US011821124B2

(12) United States Patent
Vriezema et al.

(10) Patent No.: US 11,821,124 B2
(45) Date of Patent: Nov. 21, 2023

(54) DYNAMIC SEAL FOR WASHER AND DRYER COMBINATION APPLIANCE

(71) Applicant: Whirlpool Corporation, Benton Harbor, MI (US)

(72) Inventors: Michael Vriezema, St. Joseph, MI (US); Arun Rajendran, St. Joseph, MI (US); Logan R. Urbanski, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 388 days.

(21) Appl. No.: 17/240,056

(22) Filed: Apr. 26, 2021

(65) Prior Publication Data

US 2022/0341074 A1 Oct. 27, 2022

(51) Int. Cl.
*D06F 25/00* (2006.01)
*D06F 58/06* (2006.01)

(52) U.S. Cl.
CPC ..... *D06F 25/00* (2013.01); *D06F 58/06* (2013.01)

(58) Field of Classification Search
CPC ..... D06F 25/00; D06F 58/06
USPC ..... 34/595–610
See application file for complete search history.

(56) References Cited

U.S. PATENT DOCUMENTS 8,572,862 B2 * 11/2013 TeGrotenhuis ..... D06F 58/20 96/6
9,212,450 B2 * 12/2015 Grunert ..... D06F 58/206
9,249,538 B2 * 2/2016 Bison ..... D06F 58/24
9,739,110 B2 * 8/2017 Molaschi ..... E21B 33/064
10,280,553 B2 * 5/2019 Shin ..... F04D 29/22
(Continued)

FOREIGN PATENT DOCUMENTS

CN 115323721 A * 11/2022 ..... D06F 25/00
EP 3919665 A1 12/2021
(Continued)

OTHER PUBLICATIONS

Inflatable Silicone Gasket Manufacturers | Neoprene FBD Gasket | Sun Sil Polymers; By: Sun Sil Polymers Pvt Ltd, Bengaluru; Dated Dec. 22, 2020; 7 Pages / https://www.sunsilpolymers.com/silicone-fbd-inflatable-gasket.html.
(Continued)

*Primary Examiner* — Stephen M Gravini
(74) *Attorney, Agent, or Firm* — Harness, Dickey & Pierce, PLC

(57) ABSTRACT

A washer and dryer combination appliance including a housing, a drum positioned in the housing, and a dynamic, expandable seal positioned between the drum and the housing. A laundry compartment inside the drum is accessible through openings in the front of the housing and drum. The drum has a rear wall with perforations that permit air to flow into the laundry compartment. An air gap is located between the rear of the housing and the rear wall of the drum. The dynamic, expandable seal, is actuatable between a retracted position and an extended position. In the extended position, the dynamic, expandable seal extends across the air gap to direct airflow through the perforations in the rear wall of the drum. In the retracted position, the dynamic, expandable seal is spaced away from the drum and therefore does not add any drag on the drum as the drum rotates.

20 Claims, 7 Drawing Sheets

(56) References Cited

U.S. PATENT DOCUMENTS

| | | | | |
|---|---|---|---|---|
| 10,577,740 | B2 * | 3/2020 | Lv | D06F 39/083 |
| 10,662,574 | B2 * | 5/2020 | Bocchino | D06F 58/22 |
| 10,765,974 | B2 * | 9/2020 | Renz | D06F 58/22 |
| 2016/0101303 | A1 | 4/2016 | Rockwell et al. | |
| 2022/0341074 | A1 * | 10/2022 | Vriezema | D06F 25/00 |

FOREIGN PATENT DOCUMENTS

| | | | |
|---|---|---|---|
| JP | 4541023 | B2 | 9/2010 |
| JP | 4785775 | B2 | 10/2011 |
| WO | 2007148746 | A1 | 12/2007 |
| WO | 2014181493 | A1 | 11/2014 |
| WO | 2016050295 | A1 | 4/2016 |

OTHER PUBLICATIONS

European Search Report for European Application No. 22167484.9-1016, dated Sep. 22, 2022 (200 Pages).

* cited by examiner

DYNAMIC SEAL FOR WASHER AND DRYER COMBINATION APPLIANCE

FIELD

The present disclosure relates generally to laundry machines and more particularly to a sealing apparatus for a washer and dryer combination appliance.

BACKGROUND

The statements in this section merely provide background information related to the present disclosure and may not constitute prior art.

Laundry machines are prolific in both residential and commercial settings. Traditionally, separate washer and dryer machines have been used in tandem to clean and dry laundry. However, there is a growing market for washer and dryer combination appliances where a single machine performs both the washing and drying functions, thereby eliminating the need for two separate machines. There are a number of different names used to describe washer and dryer combination appliances, including without limitation, "washer/dryer combos" and "all-in-one washer dryers." While these units save space compared to separate washer and dryer machines, combining the washing and drying functions into a single appliance presents a number of engineering challenges.

Many washer and dryer combination appliances have a front-load appliance configuration, where the washer and dryer combination appliance includes an appliance housing with a front opening that is accessed by a front-mounted appliance door. A drum is positioned in and is rotatable with respect to the appliance housing. During tumbling, a motor housed within the appliance housing rotates the drum. The drum typically has a front end with a drum opening that provides access to a laundry compartment inside the drum. The drum also may have a rear wall that is perforated to permit air flow into the laundry compartment. In such a configuration, the air inlet opening is typically located at the rear of the appliance housing, but some of the inlet air flows around the drum instead of through the perforations in the rear wall and into the laundry compartment. Thus, one of the engineering challenges presented by washer and dryer combination appliances is how to direct more air through the laundry compartment during the drying cycle for improved drying performance without interfering with the system requirements associated with the wash cycle. The apparatus described herein helps address this problem.

SUMMARY

This section provides a general summary of the disclosure, and is not a comprehensive disclosure of its full scope or all of its features.

In accordance with one aspect of the present disclosure, an apparatus for a washer and dryer combination appliance is provided, where the apparatus includes a drum housing, a drum positioned in and rotatable with respect to the drum housing, and provisions for a dynamic, expandable seal positioned between the drum and the drum housing. The drum housing includes a front housing end with a housing opening and a rear housing end with a rear housing wall. The drum includes a front drum end with a drum opening and a rear drum end with a rear drum wall. A laundry compartment is located inside the drum, which is accessible through the housing opening and the drum opening. The rear drum wall includes perforations that permit air to flow into the laundry compartment. An air gap is located between the rear housing wall and the rear drum wall and the dynamic, expandable seal, is attached to either the rear housing wall or the rear drum wall. The dynamic, expandable seal is actuatable between a retracted position and an extended position. In the extended position, the dynamic, expandable seal extends across the air gap to direct airflow through the perforations in the rear drum wall.

In accordance with another aspect of the present disclosure, the air gap located between the rear housing wall and the rear drum wall has a nominal width that equals the distance between the rear housing wall and the rear drum wall. Thus, in the extended position, the dynamic, expandable seal has an expanded width that extends across at least ninety percent of the nominal width of the air gap. Conversely, in the retracted position, the expanded width of the dynamic, expandable seal is small such that the dynamic, expandable seal does not add any drag (i.e., friction) on the drum as it rotates inside the appliance housing.

In accordance with another aspect of the present disclosure, a washer and dryer combination appliance including the apparatus described above is provided. The washer and dryer combination appliance has an appliance housing with a front opening and an appliance door that is pivotally connected to the appliance housing. The appliance door swings between an open position and a closed position. In the closed position, the appliance door closes the front opening in the appliance housing. The drum housing is fixedly mounted inside the appliance housing and defines a housing cavity. The drum housing includes a rear housing wall with an air inlet opening that is arranged in fluid communication with the housing cavity. The drum is positioned in the housing cavity and is rotatable with respect to the drum housing about a longitudinal axis. A drive shaft, coupled to the drum, extends co-axially along the longitudinal axis and through the rear housing wall. A motor, positioned in the appliance housing, is coupled to the drive shaft and is configured to drive rotation of the drive shaft and therefore the drum relative to the drum housing during operation of the washer and dryer combination appliance.

In the extended position, the dynamic, expandable seal creates a sealed region in the air gap that is arranged in fluid communication with the air inlet opening in the rear housing wall. As such, the dynamic, expandable seal directs air through the perforations in the rear drum wall and into the laundry compartment and blocks the air from flowing radially outwardly and around the drum when the dynamic, expandable seal is in the extended position. The washer and dryer combination appliance further includes a controller that actuates the dynamic, expandable seal. In operation, the controller places the dynamic, expandable seal in the extended position during a drying cycle of the washer and dryer combination appliance and places the dynamic, expandable seal in the retracted position during a wash cycle of the washer and dryer combination appliance. This allows the dynamic, expandable seal to direct more air through the laundry compartment during the drying cycle for improved drying performance without adding friction induced drag on the drum during the wash cycle.

BRIEF DESCRIPTION OF THE DRAWINGS

Other advantages of the present disclosure will be readily appreciated, as the same becomes better understood by reference to the following detailed description when considered in connection with the accompanying drawings wherein.

DETAILED DESCRIPTION

Figure 1:
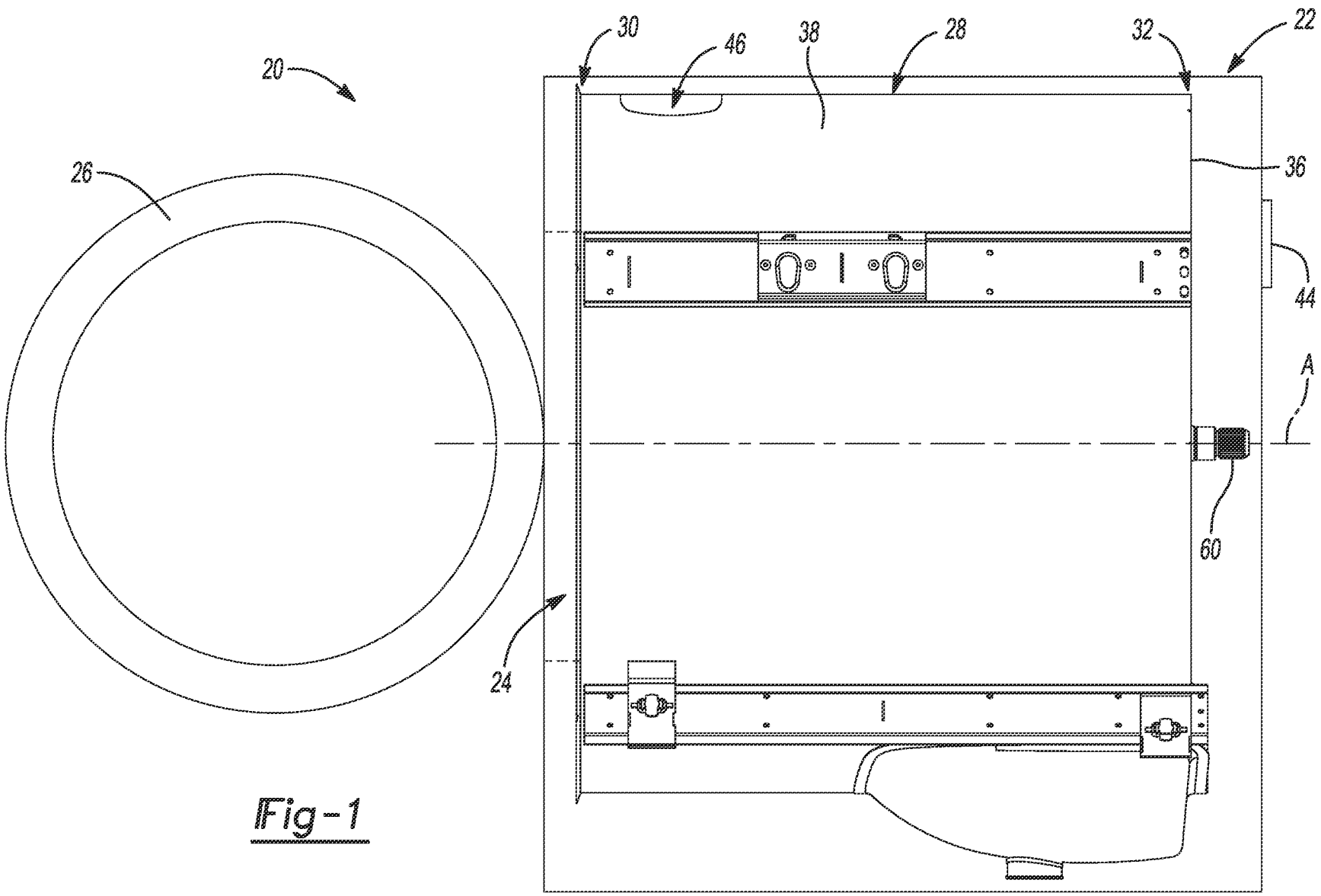
FIG. 1 is a side elevation view of an exemplary washer and dryer combination appliance where the washer and dryer combination appliance includes an appliance housing and an appliance door that are shown in broken lines.

Referring to the Figures, wherein like numerals indicate corresponding parts throughout the several views, a washer and dryer combination appliance 20 is illustrated.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

For purposes of description herein the terms "up," "down," "above," "below," "upper," "lower," "top," "bottom," "front," "rear," and derivatives thereof shall relate to the assembly as oriented in FIGS. 1-9. However, it is to be understood that the apparatus and assemblies described herein may assume various alternative orientations.

With reference to FIG. 1, a washer and dryer combination appliance 20 having a front-load configuration is illustrated. The washer and dryer combination appliance 20 includes an appliance housing 22 that is rectangular in shape and that includes a front opening 24. An appliance door 26 is pivotally connected to the appliance housing 22. The appliance door 26 swings between an open position and a closed position. In the closed position, the appliance door 26 shuts or closes the front opening 24 in the appliance housing 22.

Figure 2:
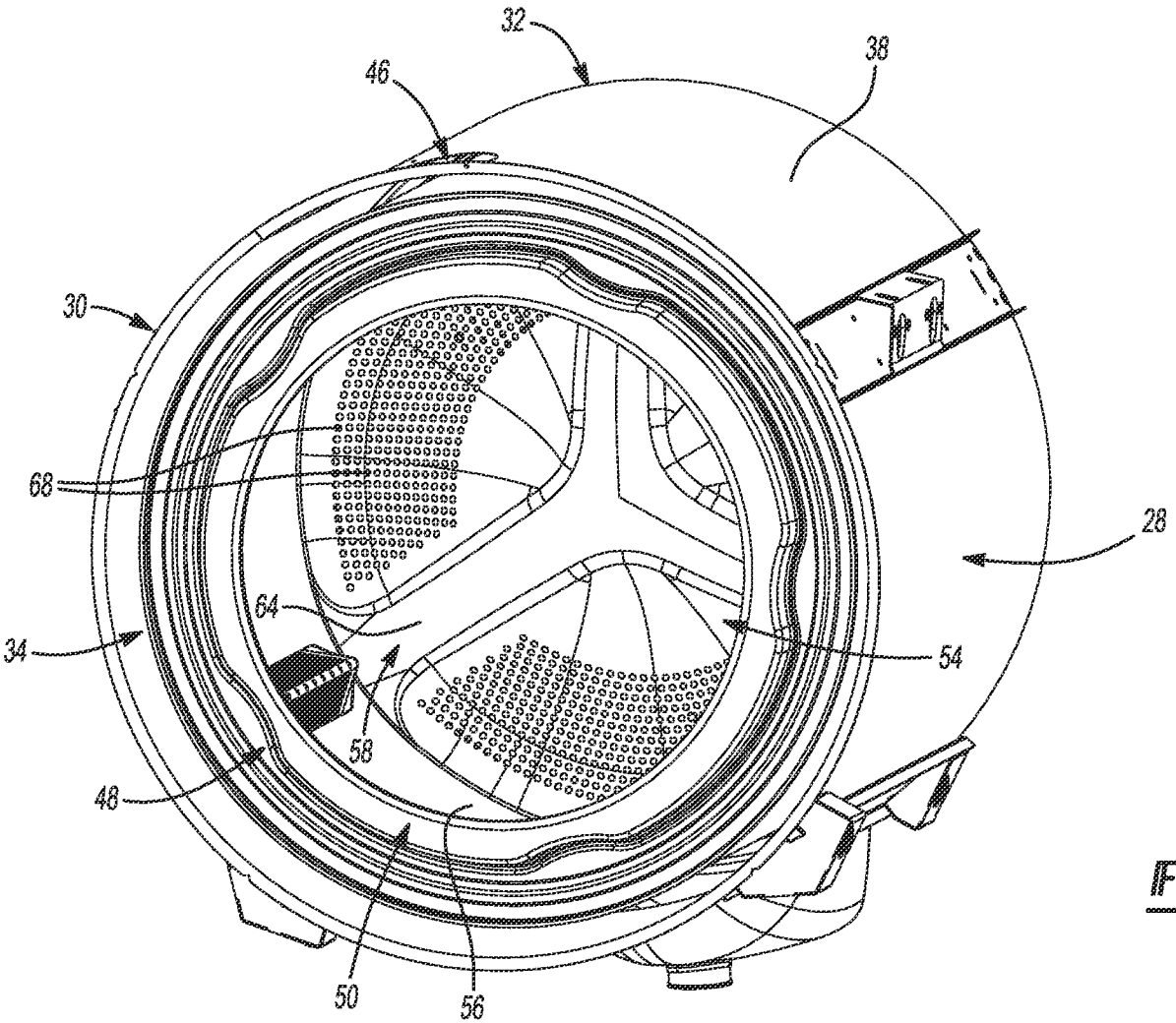
FIG. 2 is a front perspective view of an exemplary sub-assembly of the washer and dryer combination appliance illustrated in FIG. 1.
Figure 3:
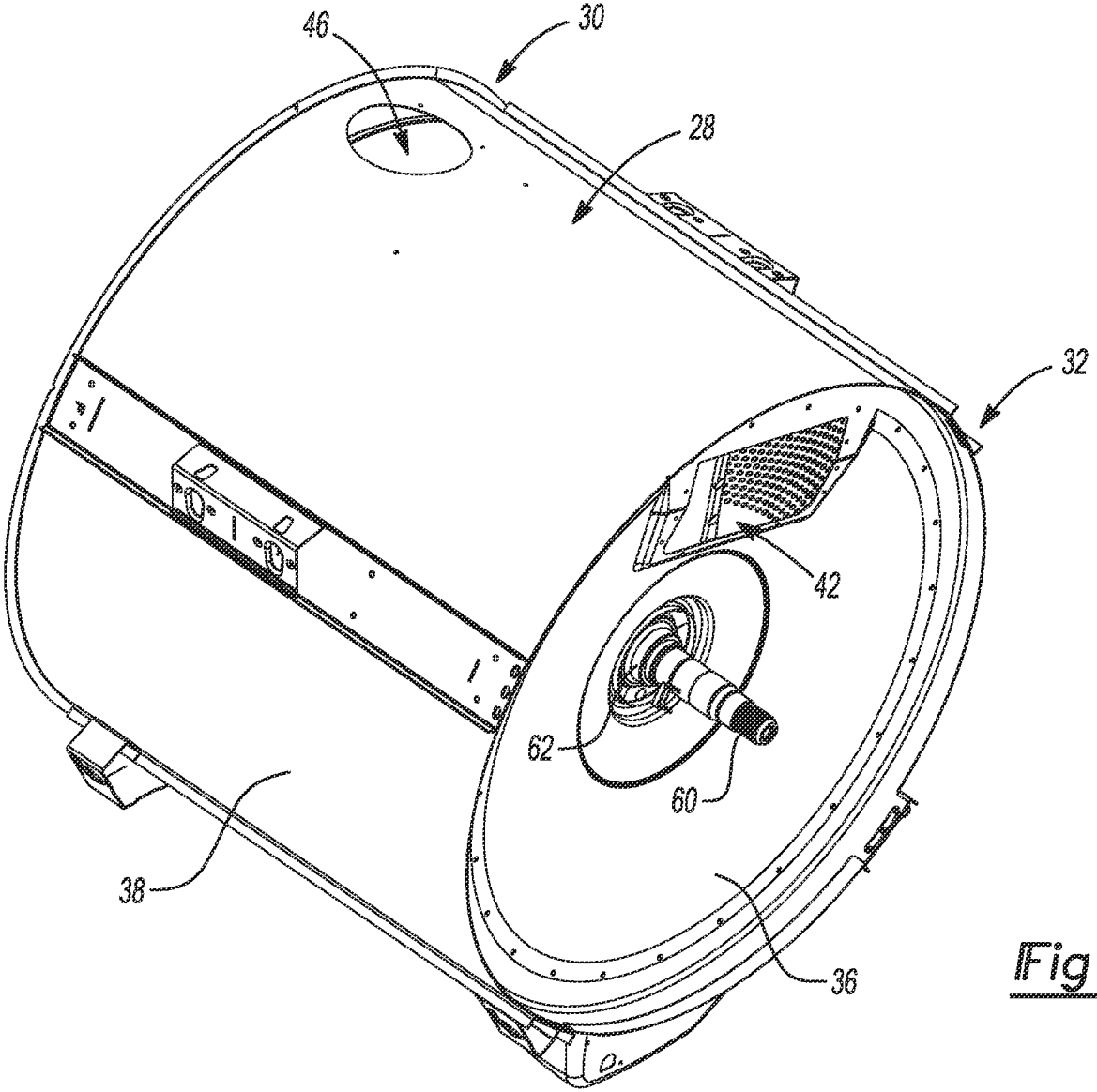
FIG. 3 is a rear perspective view of an exemplary sub-assembly of the washer and dryer combination appliance illustrated in FIG. 1.
Figure 4:
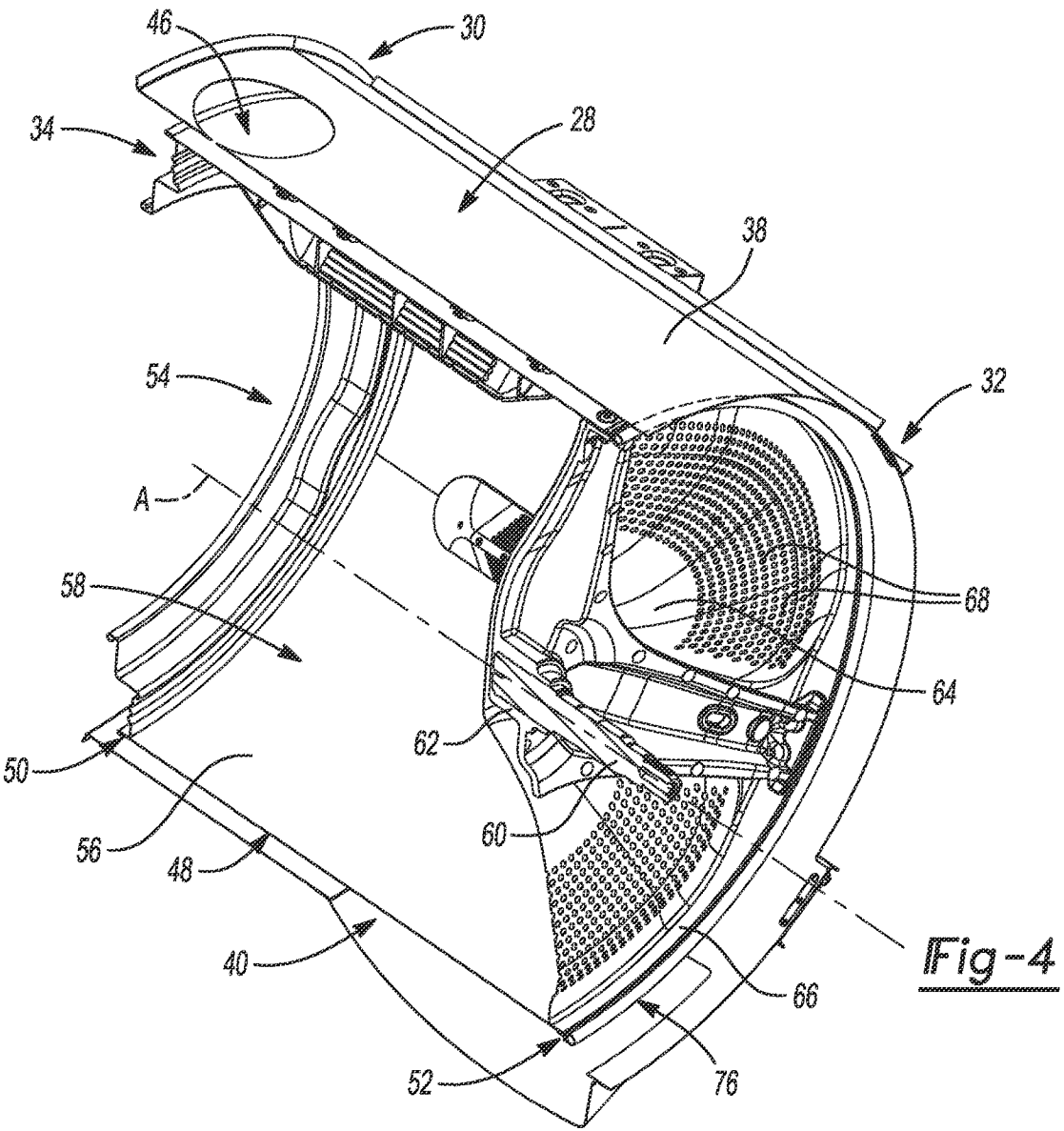
FIG. 4 is a perspective section view of an exemplary sub-assembly of the washer and dryer combination appliance illustrated in FIG. 1.

With additional reference to FIGS. 2-4, a drum housing 28 having a cylindrical shape is fixedly mounted inside the appliance housing 22. The drum housing 28 extends longitudinally between a front housing end 30 and a rear housing end 32. The drum housing 28 includes a housing opening 34 at the front housing end 30, a rear housing wall 36 at the rear housing end 32, and a housing sidewall 38 that extends longitudinally between the front and rear housing ends 30, 32. The front housing end 30, the housing sidewall 38, and the rear housing wall 36 cooperate to define a housing cavity 40 inside the drum housing 28. The rear housing wall 36 has a disc shape and includes an air inlet opening 42 at a twelve o'clock position that is arranged in fluid communication with the housing cavity 40 and an air inlet duct 44 in the appliance housing 22. The housing sidewall 38 includes an air outlet opening 46 that is positioned near the front housing end 30 at the twelve o'clock position.

A drum 48 is positioned in the housing cavity 40 such that the drum 48 is rotatable with respect to the drum housing 28 about a longitudinal axis A. The drum 48 also has a cylindrical shape and extends longitudinally between a front drum end 50 and a rear drum end 52. The drum 48 includes a drum opening 54 at the front drum end 50, a rear drum wall 64 at the rear drum end 52, and a drum sidewall 56 that extends longitudinally between the front and rear drum ends 50, 52. The front drum end 50, the drum sidewall 56, and the rear drum wall 64 cooperate to define a laundry compartment 58 inside the drum 48. The front opening 24 of the appliance housing 22, the housing opening 34 at the front housing end 30, and the drum opening 54 at the front drum end 50 are substantially aligned with one another and therefore provide access to the laundry compartment 58 inside the drum 48 when the appliance door 26 is in the open position. Thus, it should be appreciated that in use, laundry (e.g., clothes, towels, and bedding) is placed inside the laundry compartment 58 where it is first cleaned during a wash cycle and then dried during a drying cycle.

A drive shaft 60 that is fixedly coupled to the drum 48 extends co-axially along the longitudinal axis A and through the rear housing wall 36. The drive shaft 60 is supported by a bearing pack 62 that is mounted in the rear housing wall 36 such that the drive shaft 60 and the drum 48 rotate together as a single unit within the appliance housing 22. A motor (not shown) is positioned in the appliance housing 22 and is coupled to the drive shaft 60. The motor drives rotation of the drive shaft 60 and the drum 48 relative to the drum housing 28 and the appliance housing 22 during operation of the washer and dryer combination appliance 20, such as during washing and tumbling.

Figure 6:
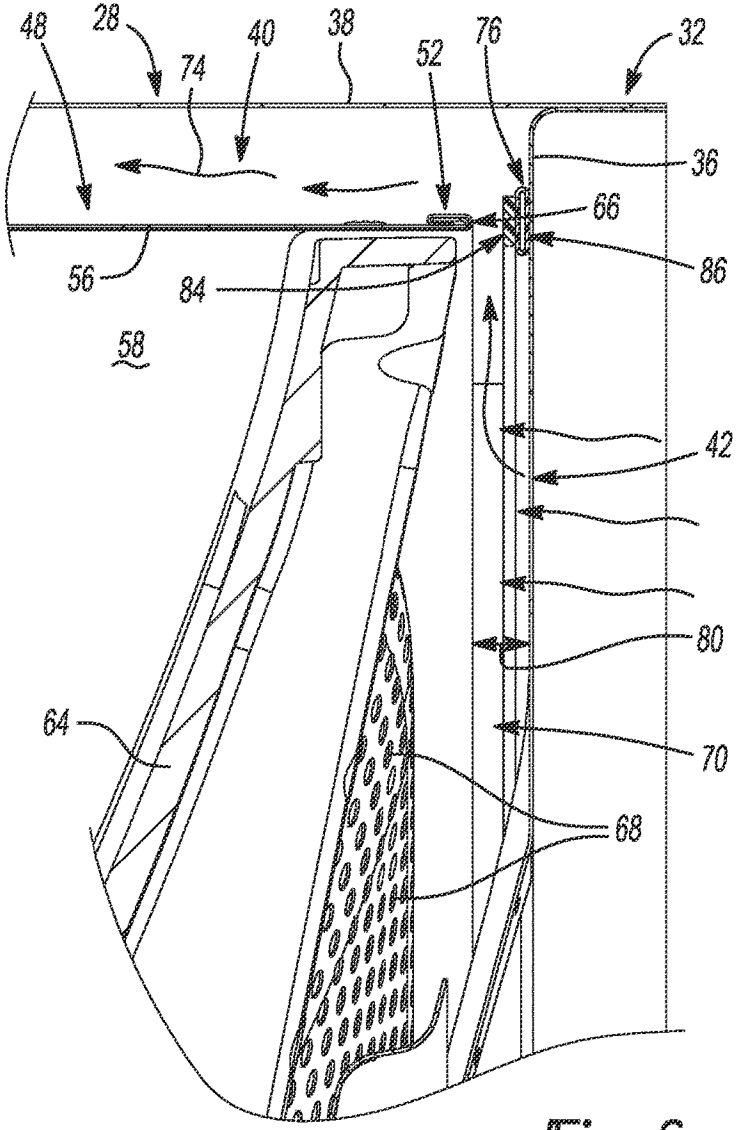
FIG. 6 is an enlarged section view of the exemplary sub-assembly illustrated in FIG. 4 where the exemplary dynamic, expandable seal is shown in a retracted position.
Figure 5:
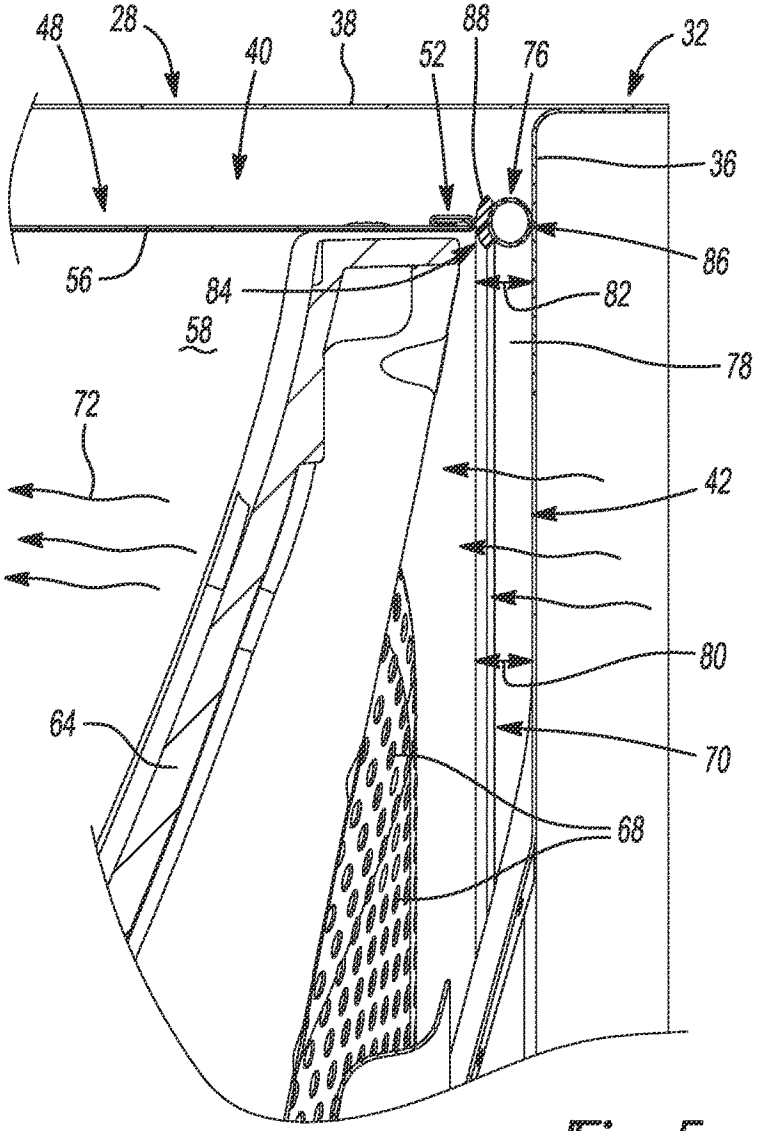
FIG. 5 is an enlarged section view of the exemplary sub-assembly illustrated in FIG. 4 where an exemplary dynamic, expandable seal is shown in an extended position.

With additional reference to FIGS. 5 and 6, the rear drum wall 64 has a disc shape and an outer perimeter 66. Perforations 68 extend through the rear drum wall 64 and permit air to flow into the laundry compartment 58 from the housing cavity 40. An air gap 70 is provided between the rear housing wall 36 and the rear drum wall 64. Both a primary air flow path 72 and a bypass air flow path 74 exist inside the drum housing 28 due to the air gap 70 between the rear housing wall 36 and the rear drum wall 64 and the clearances between the housing sidewall 38 and the drum sidewall 56. In the primary air flow path 72, air flows through the air inlet opening 42 in the rear housing wall 36 and into the air gap 70, through the perforations 68 in the rear drum wall 64 and into the laundry compartment 58, through the drum opening 54 at the front drum end 50, into the housing cavity 40, and out through the air outlet opening 46 in the housing sidewall 38. Air flowing through the primary air flow path 72 therefore helps dry wet laundry in the laundry compartment 58. In the bypass air flow path 74, air flows through the air inlet opening 42 in the rear housing wall 36, into the air gap 70, and then radially outwardly around the rear drum wall 64 and into the space between the housing sidewall 38 and the drum sidewall 56. From there, the air flows out through the air outlet opening 46 in the housing sidewall 38 without passing through the laundry compartment 58. Air flowing through the bypass air flow path 74 does not meaningfully contribute to drying and is therefore unwanted. The washer and dryer combination appliance 20 disclosed herein includes a dynamic, expandable seal 76 to minimize and/or block the bypass air flow path 74 during the drying cycle.

The dynamic, expandable seal 76, is actuatable between a retracted position and an extended position. In the extended position, the dynamic, expandable seal 76 extends across the air gap 70 to either completely or partially block the bypass air flow path 74. In the illustrated example, the dynamic, expandable seal 76 is positioned adjacent to the outer perimeter 66 of the rear drum wall 64 and, in the extended position, creates a sealed region 78 in the air gap 70 around the air inlet opening 42 in the rear housing wall 36. As such, the dynamic, expandable seal 76 directs all or substantially all of the air that enters the sealed region 78 through the perforations 68 in the rear drum wall 64 and into the laundry compartment 58 when the dynamic, expandable seal 76 is in the extended position.

The air gap 70 has a nominal width 80 that equals a distance between the rear housing wall 36 and the rear drum wall 64. It should be appreciated that the width of the air gap 70 may vary depending on the location and the drum 48 may be configured to move longitudinally relative to drum housing 28 during operation of the washer and dryer combination appliance 20 due to unbalanced loads of laundry in the laundry compartment 58 or other operating variables. Therefore, it should be understood that the nominal width 80 of the air gap 70, as the term is used herein, refers to the distance between the rear housing wall 36 and the rear drum wall 64 at the location of the dynamic, expandable seal 76 when the drum 48 is in its rest position (i.e., naturally biased position) within the drum housing 28.

The dynamic, expandable seal 76 may be attached to either the rear housing wall 36 or the rear drum wall 64 and has an expanded width 82 that extends across at least ninety percent (90%) of the nominal width 80 of the air gap 70 when the dynamic, expandable seal 76 is in the extended position. In the illustrated example, the dynamic, expandable seal 76 is attached to (i.e., is mounted to) the rear housing wall 36 and is configured to contact the outer perimeter 66 of the rear drum wall 64 when the dynamic, expandable seal 76 is in the extended position and the drum 48 is in its rest position. As such, in the illustrated example, the expanded width 82 of the dynamic, expandable seal 76 equals the nominal width 80 of the air gap 70 when the dynamic, expandable seal 76 is in the extended position. However, nothing in this description should be read as requiring the dynamic, expandable seal 76 to remain in contact with the rear drum wall 64 in the extended position during all possible movements of the drum 48 during operation of the washer and dryer combination appliance 20.

FIG. 5 illustrates the dynamic, expandable seal 76 in the extended position while FIG. 6 illustrates the dynamic, expandable seal 76 in the retracted position. The dynamic, expandable seal 76 has an inboard face 84 that contacts the rear drum wall 64 when the dynamic, expandable seal 76 is in the extended position (FIG. 5) and an outboard face 86 that is fixedly attached to the rear housing wall 36. The inboard face 84 of the dynamic, expandable seal 76 is spaced away from the rear drum wall 64 when the dynamic, expandable seal 76 is in the retracted position (FIG. 6). As such, the dynamic, expandable seal 76 does not rotate with the drum 48 during operation of the washer and dryer combination appliance 20 and does not introduce (i.e., add) any drag on the drum 48 in the retracted position. This is important because such drag on the drum 48 could trigger alarms during the wash cycle, for example. Torque on the motor may be used to determine off-balance loads during the wash cycle. Drag on the drum 48 increases torque on the motor, which is more problematic during the wash cycle where rotational speeds are higher. For example, during a wash cycle, the motor may spin the drum 48 at speeds up to 1,000 revolutions per minute (rpm). By contrast, the motor may only spin the drum 48 at speeds of 50-55 revolutions per minute (rpm) during the drying cycle. In addition, torque on the motor is greater during the wash cycle because the laundry in the laundry compartment 58 is saturated (i.e., wet) and is therefore heavier than the same load of laundry will be during the drying cycle.

Still referring to FIGS. 5 and 6, the inboard face 84 of the dynamic, expandable seal 76 includes a wear surface 88 that has a multi-layer construction and is made of an abrasion resistant material. By way of example and without limitation, the dynamic, expandable seal 76 may include a layer that is made of rubber and the wear surface 88 of the dynamic, expandable seal 76 may include another layer that is made of plastic or felt. It should also be appreciated that the dynamic, expandable seal 76 may alternatively be arranged where the inboard face 84 of the dynamic, expandable seal 76 is fixedly attached to the rear drum wall 64 and the outboard face 86 of the dynamic, expandable seal 76 is spaced away from the rear housing wall 36 when the dynamic, expandable seal 76 is in the retracted position. In accordance with this alternative arrangement (not illustrated), the dynamic, expandable seal 76 rotates with the drum 48 during operation of the washer and dryer combination appliance 20. In this arrangement, the inboard face 84 of the dynamic, expandable seal 76 may include the wear surface 88.

Figure 7:
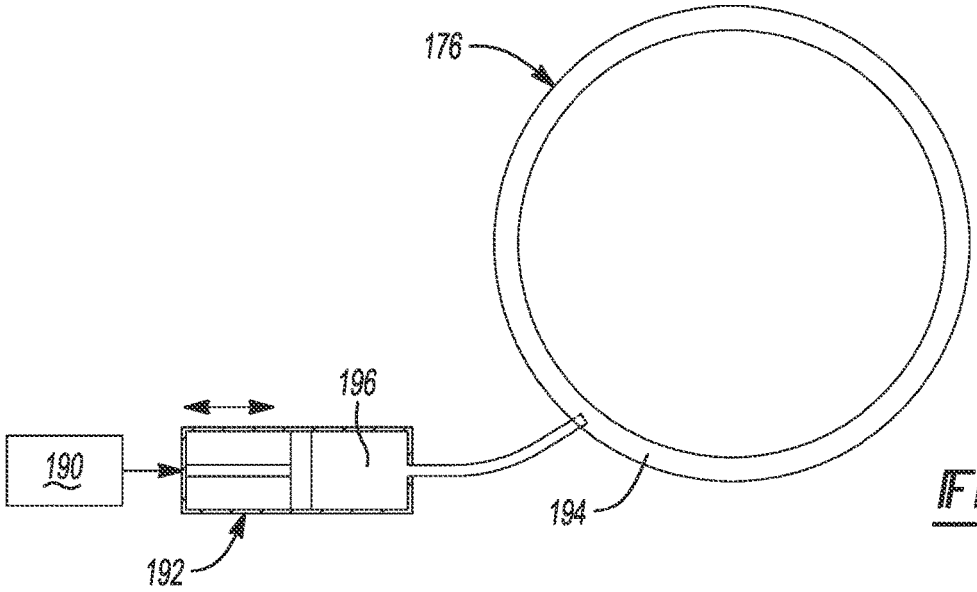
FIG. 7 is a schematic diagram of an exemplary dynamic, expandable seal that operates as a close loop system.
Figure 8:
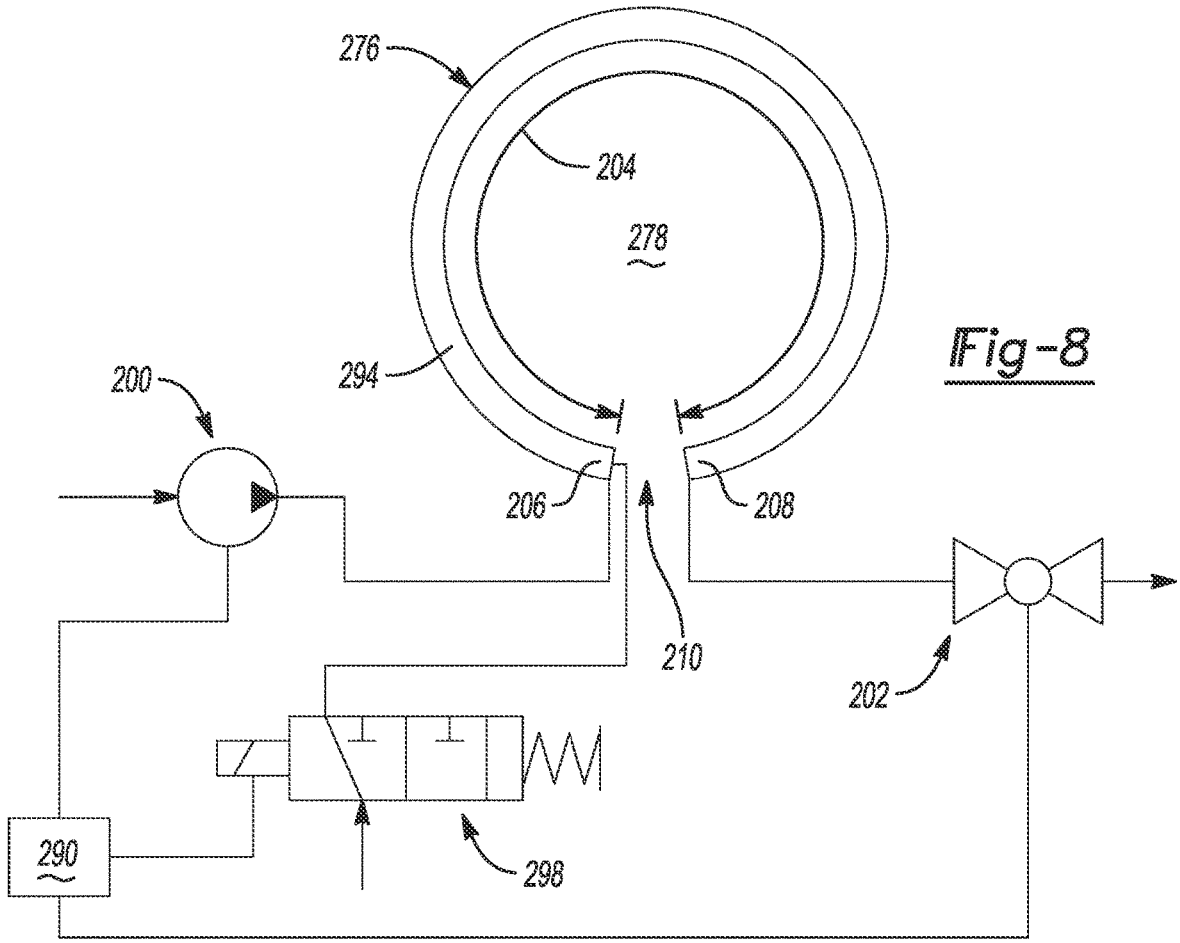
FIG. 8 is a schematic diagram of another exemplary dynamic, expandable seal that operates as an open loop system.
Figure 9:
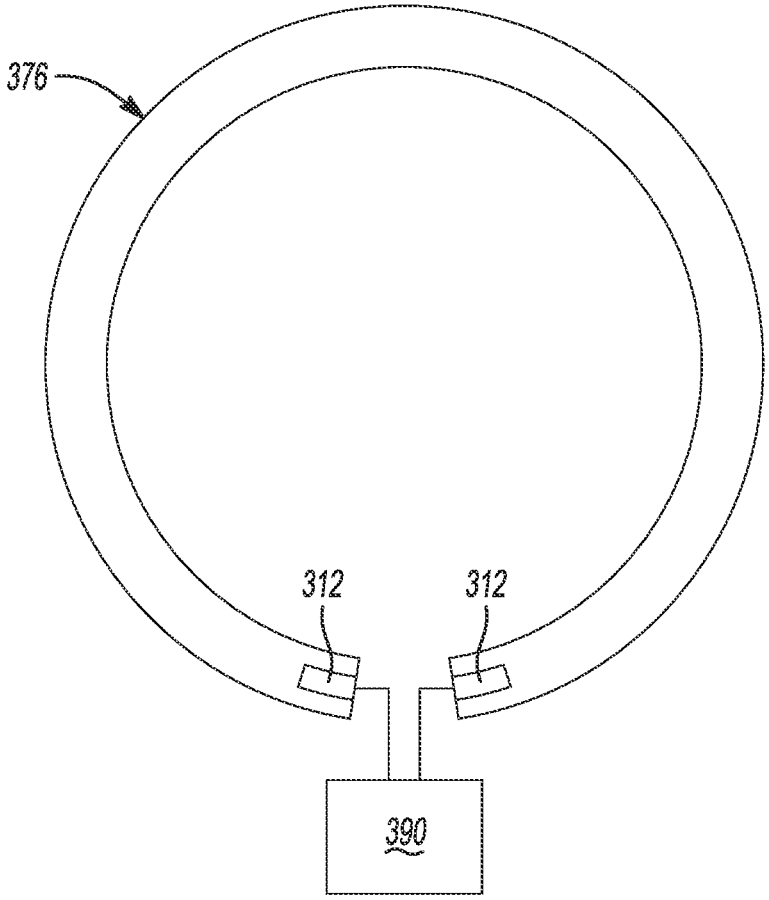
FIG. 9 is a schematic diagram of another exemplary dynamic, expandable seal that is made of a thermally expandable material.

FIGS. 7-9 illustrate different configurations and actuation systems for the dynamic, expandable seal 76 illustrated in FIGS. 1-6. In each embodiment illustrated in FIGS. 7-9, a controller 190, 290, 390 is used and configured to actuate a dynamic, expandable seal 176, 276, 376. The controller 190, 290, 390 places the dynamic, expandable seal 176, 276, 376 in the extended position during a drying cycle of the washer and dryer combination appliance 20 in order to direct/force as much air as possible along the primary air flow path 72 through the drum 48 for improved drying and efficiency. By contrast, the controller 190, 290, 390 places the dynamic, expandable seal 176, 276, 376 in the retracted position during a wash cycle of the washer and dryer combination appliance 20 to prevent the dynamic, expandable seal 176, 276, 376 from dragging on the drum 48, which could result in alarms, faults, and/or damage to the motor. As a result, the dynamic, expandable seals 76, 176, 276, 376 described herein can be fitted to a washer and dryer combination appliance 20 without having to re-calibrate, re-program, or re-design the operating parameters of the motor and associated electronics, including pre-existing alarms and fault codes.

FIG. 7 illustrates a dynamic, expandable seal 176 that is configured as a close loop system with a piston 192. In this configuration, the dynamic, expandable seal 176 is tubular and has a ring-like shape. In other words, the dynamic, expandable seal 176 includes a bladder 194 and extends in a continuous circle about the longitudinal axis A. The bladder 194 is arranged in fluid communication with the piston 192, which is electrically connected to and controlled by the controller 190. Both the bladder 194 of the dynamic, expandable seal 176 and a working chamber 196 of the piston 192 are filled with a fluid, such as air, water, hydraulic fluid, or oil. The piston 192 pushes fluid into the bladder 194 to actuate (i.e., inflate) the dynamic, expandable seal 176 and places the dynamic, expandable seal 176 in the extended position. By contrast, the piston 192 pulls fluid out of the bladder 194 to actuate (i.e., deflate) the dynamic, expandable seal 176 and places the dynamic, expandable seal 176 in the retracted position. Thus, in this configuration, the dynamic, expandable seal 176 is an inflatable seal.

FIG. 8 illustrates a dynamic, expandable seal 276 that is configured as an open loop system with an inlet valve 298 and/or a pump 200 and an outlet valve 202, all of which are electrically connected to and controlled by the controller 290. In this configuration, the dynamic, expandable seal 276 is tubular and extends across a major arc length 204. It should be appreciated that this term refers to an arc or semi-circle that is greater than 180 degrees, but less than 360 degrees. The dynamic, expandable seal 276 includes a first end 206 and a second end 208 that are positioned on opposing sides of a break 210 in the dynamic, expandable seal 76. The break 210 in the dynamic, expandable seal 276 is aligned with a six o'clock position relative to the longitudinal axis A and permits fluid and debris to drain from the sealed region 278. Once again, the dynamic, expandable seal 276 includes a bladder 294 that is arranged in fluid communication with the inlet valve 298 or the pump 200 at the first end 206 and the outlet valve 202 at the second end 208. When the controller 290 opens the inlet valve 298 and/or activates the pump 200, fluid is pushed into the bladder 294 to actuate (i.e., inflate) the dynamic, expandable seal 276 and place the dynamic, expandable seal 276 in the extended position. By contrast, when the controller 290 opens the outlet valve 202, fluid flows out of (i.e., leaves) the bladder 294 to actuate (i.e., deflate) the dynamic, expandable seal 276 and place the dynamic, expandable seal 276 in the retracted position. So the dynamic, expandable seal 276 is an inflatable seal in this configuration as well.

FIG. 9 illustrates a dynamic, expandable seal 376 that is configured as a thermal expansion device. For example, the dynamic, expandable seal 376 may be made of a thermally expandable material where an increase in temperature in the thermally expandable material causes the dynamic, expandable seal 376 to expand to the extended position and a decrease in temperature in the thermally expandable material causes the dynamic, expandable seal 376 to retract/contract to the retracted position. Alternatively, the dynamic, expandable seal 376 may include a bladder that is filled with a thermally expandable material, such as a thermally expandable fluid. In either arrangement, the dynamic, expandable seal 376 may include one or more heating coils 312 that are electrically connected to the controller 390. When the controller 390 activates the heating coils 312, the thermally expandable material expands to actuate the dynamic, expandable seal 376 and places the dynamic, expandable seal 376 in the extended position. By contrast, when the controller 390 deactivates the heating coils 312, the thermally expandable material contracts to actuate the dynamic, expandable seal 376 and places the dynamic, expandable seal 376 in the retracted position.

Many modifications and variations of the apparatus and assemblies described in the present disclosure are possible in light of the above teachings and may be practiced otherwise than as specifically described while within the scope of the appended claims. These antecedent recitations should be interpreted to cover any combination in which the inventive novelty exercises its utility.

What is claimed is:

1. An apparatus for a washer and dryer combination appliance, comprising:

a drum housing including a front housing end with a housing opening and a rear housing end with a rear housing wall;

a drum positioned in and rotatable with respect to said drum housing, said drum including a front drum end with a drum opening, a rear drum end with a rear drum wall, and a laundry compartment located inside said drum;

said rear drum wall having perforations that permit air to flow into said laundry compartment;

an air gap located between said rear housing wall and said rear drum wall; and a dynamic, expandable seal, attached to one of said rear housing wall and said rear drum wall, that is actuatable between a retracted position and an extended position, wherein said dynamic, expandable seal extends across at least part of said air gap in said extended position to direct airflow through said perforations in said rear drum wall.

2. The apparatus as set forth in claim 1 wherein said dynamic, expandable seal includes an inboard face that contacts said rear drum wall when said dynamic, expandable seal is in said extended position and an outboard face that contacts said rear housing wall when said dynamic, expandable seal is in said extended position.

3. The apparatus as set forth in claim 2 wherein said outboard face of said dynamic, expandable seal is fixedly attached to said rear housing wall and said inboard face of said dynamic, expandable seal is spaced away from said rear drum wall when said dynamic, expandable seal is in said retracted position such that said dynamic, expandable seal does not rotate with said drum during operation of said washer and dryer combination appliance.

4. The apparatus as set forth in claim 3 wherein said inboard face of said dynamic, expandable seal includes a wear surface that is made of an abrasion resistant material.

5. The apparatus as set forth in claim 4 wherein said wear surface has a multi-layer construction.

6. The apparatus as set forth in claim 2 wherein said inboard face of said dynamic, expandable seal is fixedly attached to said rear drum wall and said outboard face of said dynamic, expandable seal is spaced away from said rear housing wall when said dynamic, expandable seal is in said retracted position such that said dynamic, expandable seal rotates with said drum during operation of said washer and dryer combination appliance.

7. The apparatus as set forth in claim 6 wherein said inboard face of said dynamic, expandable seal includes a wear surface that is made of an abrasion resistant material.

8. The apparatus as set forth in claim 7 wherein said wear surface has a multi-layer construction.

9. The apparatus as set forth in claim 1 wherein said dynamic, expandable seal is tubular.

10. The apparatus as set forth in claim 9 wherein said dynamic, expandable seal includes a bladder that is arranged in fluid communication with a pump that is configured to inflate and deflate said bladder with a fluid.

11. The apparatus as set forth in claim 10 wherein said fluid is air, water, hydraulic fluid, or oil.

12. The apparatus as set forth in claim 10, further comprising:

a controller electrically connected to said pump and configured to actuate said dynamic, expandable seal, place said dynamic, expandable seal in said extended position during a drying cycle of said washer and dryer combination appliance, and place said dynamic, expandable seal in said retracted position during a wash cycle of said washer and dryer combination appliance.

13. The apparatus as set forth in claim 1 wherein said rear housing wall has an air inlet opening and wherein said dynamic, expandable seal, in said extended position, creates a sealed region around said air inlet opening such that said dynamic, expandable seal directs said air through said perforations in said rear drum wall and into said laundry compartment and blocks said air from flowing radially outwardly and around said drum when said dynamic, expandable seal is in said extended position.

14. The apparatus as set forth in claim 13 wherein said dynamic, expandable seal extends across a major arc length and includes a first end and a second end positioned on opposing sides of a break in said dynamic, expandable seal that permits fluid and debris to drain from said sealed region.

15. The apparatus as set forth in claim 1 wherein said dynamic, expandable seal extends in a continuous circle and has a ring-like shape.

16. The apparatus as set forth in claim 1 wherein said air gap has a nominal width equaling a distance between said rear housing wall and said rear drum wall and wherein said dynamic, expandable seal has an expanded width that extends across at least ninety percent of said nominal width of said air gap when said dynamic, expandable seal is in said expanded position.

17. The apparatus as set forth in claim 1 wherein said dynamic, expandable seal is made of a thermally expandable material wherein an increase in temperature in said thermally expandable material causes said dynamic, expandable seal to expand to said extended position and a decrease in temperature in said thermally expandable material causes said dynamic, expandable seal to retract to said retracted position.

18. An apparatus for a washer and dryer combination appliance, comprising:

a drum housing extending longitudinally between a front housing end and a rear housing end;

said drum housing including a housing opening at said front housing end, a rear housing wall at said rear housing end, and a housing cavity;

a drum positioned in said housing cavity and rotatable with respect to said drum housing about a longitudinal axis;

said drum extending longitudinally between a front drum end and a rear drum end;

said drum including a drum opening at said front drum end, a rear drum wall at said rear drum end, and a laundry compartment;

said rear drum wall having perforations that permit air to flow from said housing cavity to said laundry compartment;

an air gap located between said rear housing wall and said rear drum wall that has a nominal width equaling a distance between said rear housing wall and said rear drum wall; and a dynamic, expandable seal, attached to one of said rear housing wall and said rear drum wall, that is actuatable between a retracted position and an extended position, wherein said dynamic, expandable seal extends across said air gap and has an expanded width that equals at least ninety percent of said nominal width of said air gap in said extended position.

19. The apparatus as set forth in claim 18 wherein said dynamic, expandable seal is positioned adjacent to an outer perimeter of said rear drum wall.

20. A washer and dryer combination appliance, comprising:

an appliance housing including a front opening;

an appliance door pivotally connected to said appliance housing that swings between an open position and a closed position where said appliance door closes said front opening in said appliance housing;

a drum housing fixedly mounted inside said appliance housing;

said drum housing extending longitudinally between a front housing end and a rear housing end;

said drum housing including a housing opening at said front housing end, a rear housing wall at said rear housing end, and a housing sidewall that extends longitudinally between said front and rear housing ends and defines a housing cavity;

said rear housing wall having an air inlet opening that is arranged in fluid communication with said housing cavity;

a drum positioned in said housing cavity and rotatable with respect to said drum housing about a longitudinal axis;

said drum extending longitudinally between a front drum end and a rear drum end;

said drum including a drum opening at said front drum end, a rear drum wall at said rear drum end, and a drum sidewall that extends longitudinally between said front and rear drum ends and defines a laundry compartment inside said drum;

said rear drum wall having perforations that permit air to flow from said housing cavity to said laundry compartment;

a drive shaft, coupled to said drum, that extends co-axially along said longitudinal axis and through said rear housing wall;

a motor positioned in said appliance housing and coupled to said drive shaft that is configured to drive rotation of said drive shaft and said drum relative to said drum housing during operation of said washer and dryer combination appliance;

an air gap located between said rear housing wall and said rear drum wall;

a dynamic, expandable seal, attached to one of said rear housing wall and said rear drum wall, that is actuatable between a retracted position and an extended position where said dynamic, expandable seal extends across said air gap in said extended position;

said dynamic, expandable seal, in said extended position, creates a sealed region in said air gap that is arranged in fluid communication with said air inlet opening in said rear housing wall such that said dynamic, expandable seal directs said air through said perforations in said rear drum wall and into said laundry compartment and blocks said air from flowing radially outwardly and around said drum when said dynamic, expandable seal is in said extended position; and a controller configured to actuate said dynamic, expandable seal and place said dynamic, expandable seal in said extended position during a drying cycle of said washer and dryer combination appliance and place said dynamic, expandable seal in said retracted position during a wash cycle of said washer and dryer combination appliance.

* * * * *